US007650106B2

(12) United States Patent
Kim

(10) Patent No.: US 7,650,106 B2
(45) Date of Patent: Jan. 19, 2010

(54) PRESSURE ROLLER FOR AN IMAGE FORMING APPARATUS AND METHOD OF MANUFACTURING THE SAME

(75) Inventor: Jong Min Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 232 days.

(21) Appl. No.: 11/762,386

(22) Filed: Jun. 13, 2007

(65) Prior Publication Data

US 2008/0101829 A1 May 1, 2008

(30) Foreign Application Priority Data

Oct. 27, 2006 (KR) ..... 10-2006-0105130

(51) Int. Cl.
*G03G 15/20* (2006.01)

(52) U.S. Cl. ..... 399/331

(58) Field of Classification Search ..... 399/107, 399/122, 320, 328, 330, 331; 219/216; 462/38, 462/56, 59

See application file for complete search history.

(56) References Cited

U.S. PATENT DOCUMENTS 3,883,293 A 5/1975 McCarroll
5,345,301 A 9/1994 Satoh et al.
6,311,615 B1 11/2001 Hilliard
7,418,230 B2 * 8/2008 Zess et al. ..... 399/331

FOREIGN PATENT DOCUMENTS

| | | |
|---|---|---|
| EP | 0734873 | 10/1996 |
| JP | 5-241467 | 9/1993 |
| JP | 9-204113 | 8/1997 |

OTHER PUBLICATIONS

Office Action issued in corresponding European Patent Application No. 07110818.7 dated Jan. 23, 2008.
Office Action issued by The State Intellectual Property Office of the People's Republic of China on Feb. 27, 2009.

* cited by examiner

*Primary Examiner*—Hoan H Tran
(74) *Attorney, Agent, or Firm*—Stein McEwen, LLP

(57) ABSTRACT

An image forming apparatus capable of preventing sheets from being crumpled due to compressive deformation of a resilient layer thereof when the sheets pass through a fixing unit, and a method for manufacturing the same. The pressure roller may include a reinforcing member that reinforces a side of the resilient layer to prevent an axial compressive deformation of the resilient layer, a reinforcing member received between the shaft and the resilient layer to increase hardness of the resilient layer, or a reinforcing member interposed between the shaft and the resilient layer to reduce the compressive deformation of the resilient layer.

15 Claims, 12 Drawing Sheets

PRESSURE ROLLER FOR AN IMAGE FORMING APPARATUS AND METHOD OF MANUFACTURING THE SAME

CROSS-REFERENCE TO RELATED APPLICATION

This application claims all benefits accruing under 35 U.S.A. §119 from Korean Patent Application No. 2006-105 filed on Oct. 27, 2006 in the Korean Intellectual Property Office, the disclosure of which is incorporated herein by reference.

BACKGROUND OF THE INVENTION

1. Field of the Invention

An aspect of the present invention relates to an image forming apparatus, and, more particularly, to an image forming apparatus, which includes a pressure roller that is brought into contact with a heating roller to form a fixing nip.

2. Description of the Related Art

An image forming apparatus, such as, a printer, a photocopier, a facsimile machine and a multi-functional product, is an apparatus used for printing images on sheets of print media in response to input image signals. One type of image forming apparatuses is an electrophotographic image forming apparatus. This type of image forming apparatus includes a light scanning unit to scan an optical signal corresponding to a target image onto a photosensitive medium, a development unit to develop the electrostatic latent image into a visible image by supplying toner to the photosensitive medium on which the electrostatic latent image is formed, and a fixing unit to fix the visible image once the image is transferred to a print medium, such as, a sheet of paper.

FIG. 1 is a side sectional view and FIG. 2 is a front sectional view schematically showing a conventional fixing unit. As shown in FIGS. 1 and 2, the fixing unit 1 generally includes a heating roller 3 having a heat source 2 installed therein, and a pressure roller 4 to be brought into close contact with the heating roller 3 to form a fixing nip N at a contact portion therebetween. The heating roller 4 includes a shaft 5 formed from a metallic material such as aluminum or steel, and a resilient layer 6 surrounding the shaft 5. As shown in FIG. 2, the shaft 5 is provided at either end thereof with a spring 7 to force the heating roller 3 to be brought into the close contact with the pressure roller 4 by elastically biasing the pressure roller 4 towards the heating roller 3.

As the sheet having the toner image transferred thereon enters between the heating roller 3 and the pressure roller 4, both of which are rotated, the toner image is fixed onto the sheet by heat delivered from the heating roller 3 and pressure between the heating roller 3 and the pressure roller 4.

To prevent the sheet from being crumpled due to the heat and pressure during such a fixing process, the pressure roller 4 may be machined to have a reversed-crown shape. That is, the pressure roller 4 has relatively large diameters at opposite ends thereof and a relatively small diameter at a central region thereof. As a result of the pressure roller 4 having the reversed-crown shape, the sheet has a higher linear velocity where the sheet is brought into contact with the opposite ends of the pressure roller 4 than where the sheet is brought into contact with the central region of the pressure roller 4. Thus, the sheet undergoes outward tension when entering the fixing unit that prevents the sheet from being crumpled.

However, since a conventional pressure roller has a free surface at either side of the resilient layer 6 that extends in a longitudinal direction of the sheet, there is a problem in that the resilient layer 6 is deformed in an axial direction of the pressure roller 4 as a result of the compression of the spring 7 (see Region A in FIG. 2). If the resilient layer 6 is deformed, the diameters of the pressure roller 4 at both sides are reduced, thereby weakening the crumple prevention ability of the pressure roller. This problem may also be caused if the pressure roller 4 is not machined to have the reversed-crown shape such that the sheet has a more rapid linear velocity at the central region of the pressure roller 4. Furthermore, when the pressure roller 4 is decreased in diameter due to deformation of the resilient layer 6, the width of the fixing nip created between the heating roller 3 and the pressure roller 4 is changed to an unexpected shaped degree, thereby making maintenance of a stable fixing performance difficult.

SUMMARY OF THE INVENTION

Therefore, aspects of the invention provide an image forming apparatus, which includes a pressure roller having a resilient layer capable of preventing a sheet from being crumpled due to compressive deformation of opposite ends of the resilient layer while the sheet passes through a fixing unit, and a method for manufacturing the same. Other aspect of the present invention provide the image forming apparatus, which can prevent a fixing nip created between a heating roller and the pressure roller from being deformed into an unexpected shape to keep a stable fixing performance, and a method for manufacturing the same.

In accordance with one aspect of the present invention, an image forming apparatus is provided, including: a heating roller having a heat source installed therein; a pressure roller, including a shaft and a resilient layer, to be brought into contact with the heating roller to form a fixing nip between the pressure roller and the heating roller; and a reinforcing member to reinforce a side of the resilient layer so as to prevent a compressive deformation of the resilient layer.

The reinforcing member may include a pass-hole through which the shaft extends; and a reinforcing surface closely attached to the side of the resilient layer to prevent the deformation of the resilient layer.

The reinforcing member may have a disc shape, and a radius smaller than a distance between a center of the shaft and an outer peripheral surface of the resilient layer.

In accordance with another aspect of the present invention, an image forming apparatus is provided, including: a heating roller having a heat source installed therein; a pressure roller including a resilient layer to be compressed onto the heating roller to form a fixing nip between the pressure roller and the heating roller; and a reinforcing member received at an end of the resilient layer to increase a hardness of the resilient layer.

The reinforcing member may include iron cores inserted at constant intervals in a circumferential direction of the resilient layer.

The reinforcing member may include a cylindrical plate inserted into the resilient layer in an axial direction of the pressure roller.

In accordance with yet another aspect of the present invention, an image forming apparatus is provided, including: a heating roller having a heat source installed therein; a pressure roller, including a shaft and a resilient layer surrounding the shaft, the resilient layer being compressed onto the heating roller to form a fixing nip between the heating roller and the pressure roller; and a reinforcing member interposed between the shaft and the resilient layer at an end of the pressure roller to reduce an amount of compressive deformation of the resilient layer.

The reinforcing member may include a hollow section through which the reinforcing member is fitted into the shaft, a first reinforcing part extending a first height in a radial direction of the shaft, and a second reinforcing part extending axially from the first reinforcing part and having a second height lower than the first height.

The second reinforcing part may have a tilt surface slanted downward towards a middle of the pressure roller.

In accordance with yet another aspect of the present invention, a method for manufacturing an image forming apparatus is provided, the image forming apparatus comprising a pressure roller including a shaft and a resilient layer surrounding the shaft, the method comprising: fitting a reinforcing member into an end of the shaft to reduce an amount of compressive deformation of the resilient layer; placing the shaft fitted with the reinforcing member within a mold for use in an injection molding process; and injecting a material into the mold to form the resilient layer surrounding the shaft.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
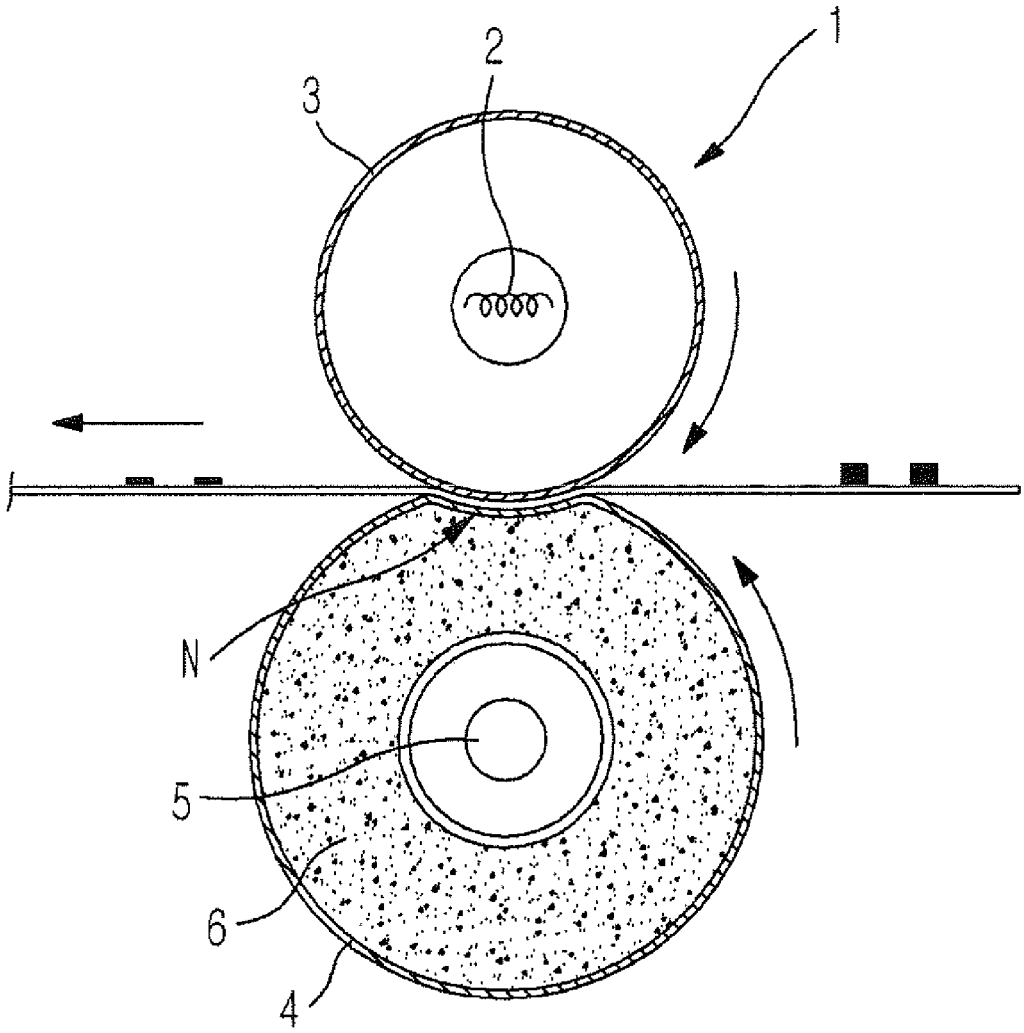
FIG.1 Related Art
FIGS. 1 and 2 are a side sectional view and a front sectional view schematically showing a conventional fixing unit.
Figure 2:
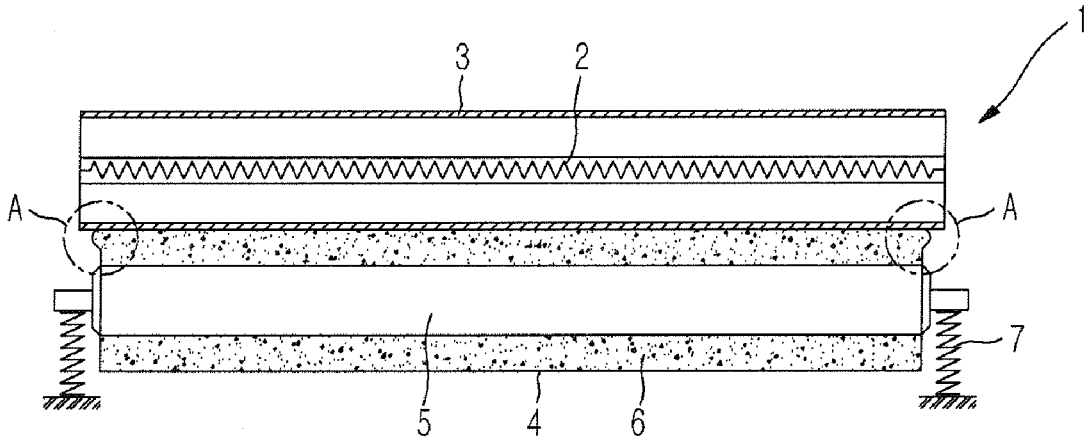
FIG.2 Related Art

Reference will now be made in detail to the present embodiments of the present invention, examples of which are illustrated in the accompanying drawings, wherein like reference numerals refer to the like elements throughout. The embodiments are described below to explain the present invention by referring to the figures.

Figure 3:
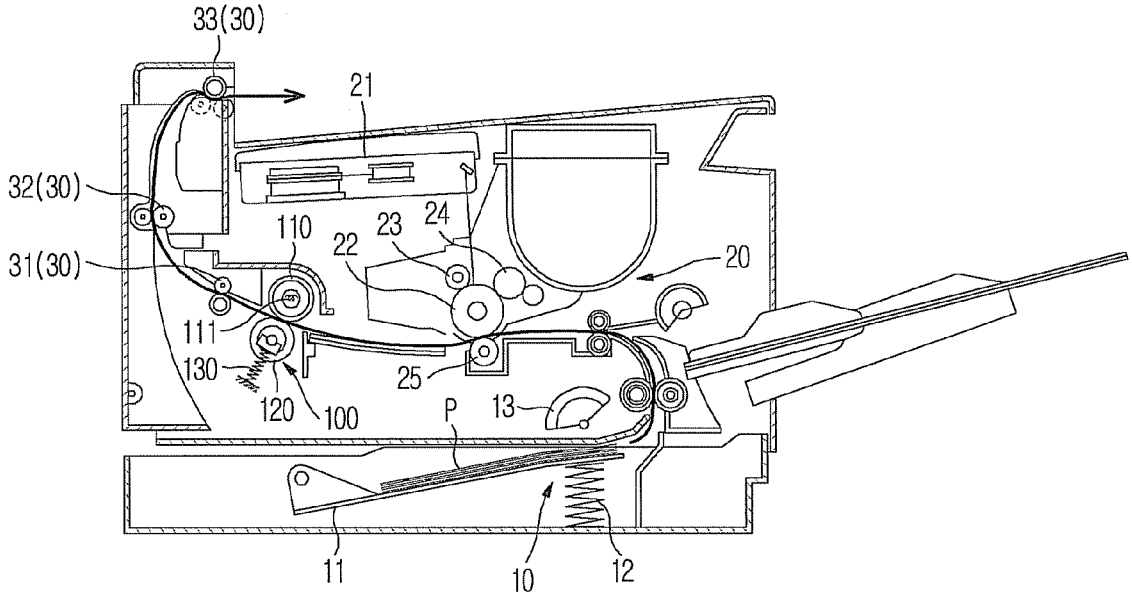
FIG. 3 is a side sectional view schematically showing the construction of an image forming apparatus according to an example embodiment of the present invention.
Figure 4:
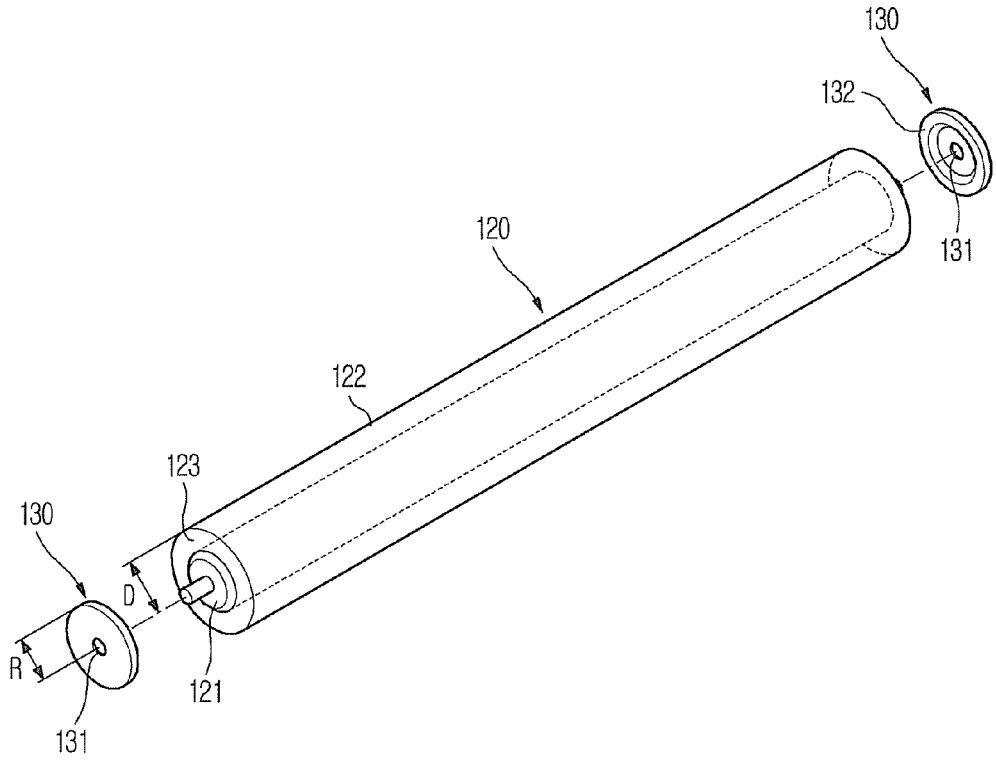
FIG. 4 is a perspective view schematically showing a pressure roller according to a first example embodiment of the present invention.

FIG. 3 is a side sectional view schematically showing the construction of an image forming apparatus according to an example embodiment of the present invention, and FIG. 4 is a perspective view schematically showing a pressure roller according to a first example embodiment of the present invention. As shown in FIGS. 3 and 4, the image forming apparatus according to the an example embodiment of the present invention comprises a sheet feeding unit 10 to feed sheets of print media P (i.e., paper, transparencies, etc.), a development unit 20 to develop images on the sheets, a fixing unit 100 to fix the developed images on the sheets through an application of heat and pressure to the sheets, and a sheet discharge unit 30 to discharge printed sheets to an exterior of the image forming apparatus.

The sheet feeding unit 10 comprises a sheet tray 11 on which the sheets P are stacked, and a spring 12 which resiliently supports the sheet tray 11 in a substantially vertical direction. The sheets stacked on the sheet tray 11 are picked up in a piece by piece sequence by a pick-up roller 13, and conveyed toward the development unit 20.

The development unit 20 comprises a photosensitive drum 22 on which an electrostatic latent image is formed by a laser scanning unit 21, a charge roller 23 to charge the photosensitive drum 22, a developing roller 24 to develop the latent image formed on the photosensitive drum 22 into a visible image, and a transfer roller 25 to bias a sheet towards the photosensitive drum 22 such that the visible image of the photosensitive drum 22 can be transferred to the sheet.

The sheet discharge unit 30 comprises first, second and third sheet discharge rollers 31, 32 and 33 that are sequentially arranged to convey the sheets passing through the fixing unit 100 to a stacking station. The stacking station is positioned at an upper portion of the image forming apparatus.

The fixing unit 100 fixes the transferred visible image onto the sheet through an application of heat and pressure to the sheet. The fixing unit 100 comprises a heating roller 110 having a heat source 111 installed therein to apply heat to the sheet to which a toner image has been transferred thereon, a pressure roller 120 installed opposite the heating roller 110 to maintain a constant fixing pressure with the heating roller 110, and a compressing mechanism 130 to elastically bias the pressure roller 120 toward the heating roller 110. The heat source 111 of the heating roller 110 may include a halogen lamp, a heat line, an induction heater, etc.

As shown in FIG. 4, the pressure roller 120 comprises a shaft 121 formed from a metallic material such as aluminum or steel, and a resilient layer 122 that is resiliently deformed to form a fixing nip between the heating roller 110 and the pressure roller 120 as the pressure roller 120 contacts the heating roller 110. The resilient layer 122 is typically formed from a silicon rubber, and has a release layer (not shown) on a surface thereof to prevent the sheet from adhering to the pressure roller 120.

In particular, the pressure roller 120 of this example embodiment comprises a reinforcing member 130 to reinforce a side 123 of the resilient layer 122, which is a free surface. The reinforcing member 130 restricts the side 123 of the resilient layer 122 so as to prevent the side 123 of the resilient layer 122 from bulging out in the axial direction due to compressive deformation of the side 123 of the resilient layer 122 that is due to the pressure exerted between the heating roller 110 and the pressure roller 120.

A pass-hole 131, through which the shaft 121 extends, is defined in the reinforcing member 130. The reinforcing member 130 also includes a reinforcing surface 132 closely attached to the side 123 of the resilient layer 122 to prevent axial deformation of the resilient layer 122. For example, according to an example embodiment of the present invention, the reinforcing member 130 is shaped like a disc. The disc shaped reinforcing member 130 may be press-fitted into an end of the shaft 121 or secured thereto by a separate fastener such as screws and the like. Meanwhile, the reinforcing member 130 has a radius R that is smaller than a distance D between the center of the shaft 121 and an outer peripheral surface of the resilient layer 122. This prevents interference between the reinforcing member 130 and the heating roller 110 when the resilient layer 122 forms the fixing nip.

Figure 5:
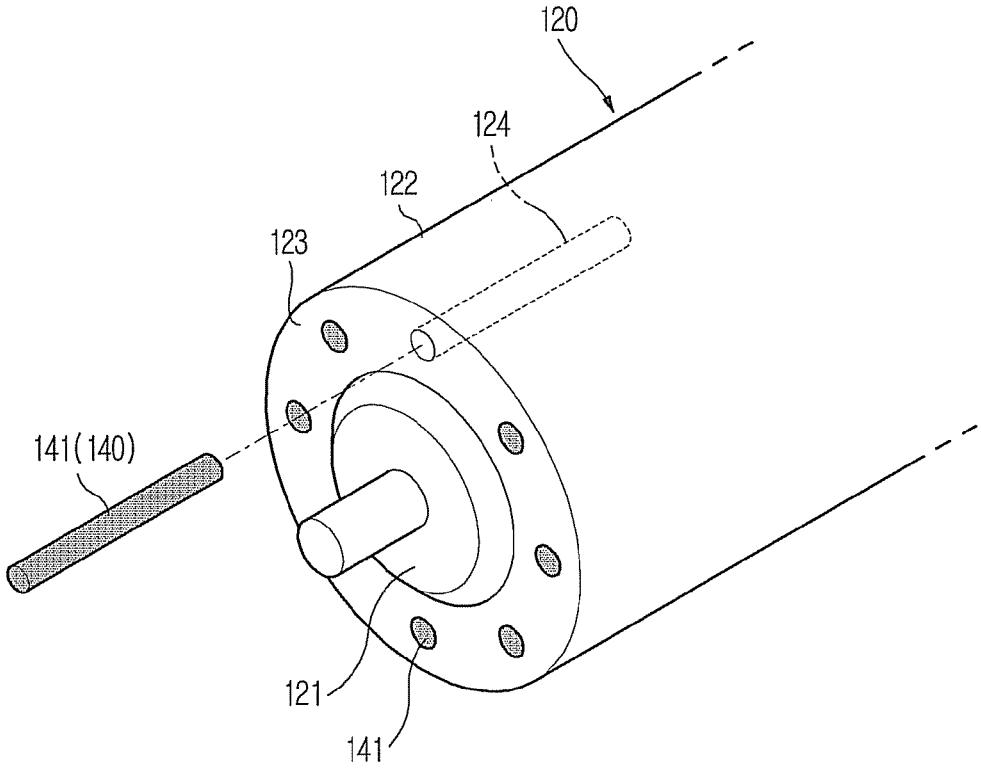
FIG. 5 is a perspective view schematically showing a pressure roller according to a second example embodiment of the present invention.
Figure 6:
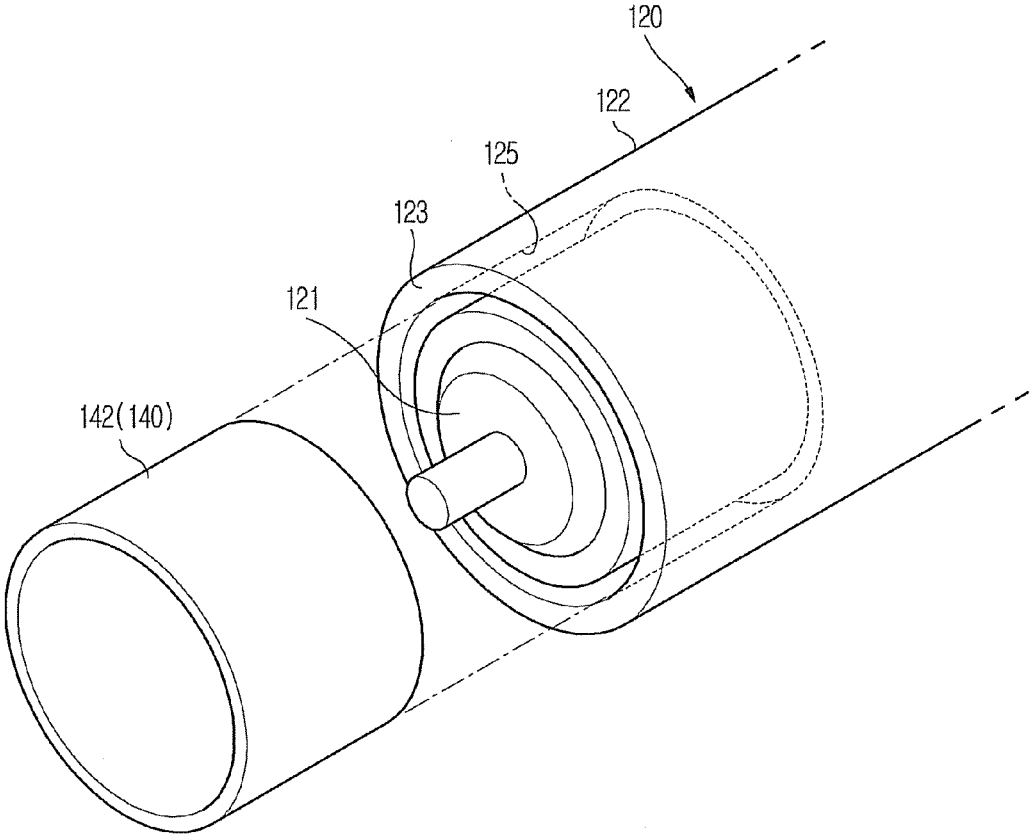
FIG. 6 is a perspective view schematically showing a pressure roller according to a third example embodiment of the present invention.

FIG. 5 is a perspective view schematically showing a pressure roller according to a second example embodiment of the present invention, and FIG. 6 is a perspective view schematically showing a pressure roller according to a third example embodiment of the present invention. In the following description, the pressure rollers of the second and third example embodiments will be described in view of different components from those of the first example embodiment, and detailed description of the same configuration as that of the first example embodiment shown in FIG. 4 will be omitted. In addition, the same components are denoted by the same reference numerals as those of FIG. 4. In FIGS. 5 and 6, only one end of the pressure roller is shown for convenience of description. Thus, it should be noted that reinforcing members are also provided to opposite ends of the pressure roller, respectively.

Referring to FIGS. 5 and 6, the pressure roller 120 may include a reinforcing member 140 that is received in the resilient layer 122 at an end thereof to increase a hardness of the resilient layer 122. As such, the portion of the resilient layer 122 having the reinforcing member 140 installed therein is compressed to a lesser degree than normal, thereby relieving the problem caused by axial deformation of the resilient layer 122.

FIG. 5 shows an example of the reinforcing member 140 which comprises iron cores 141. Here, the cores 141 are circumferentially inserted into the resilient layer 122 at constant intervals. For this purpose, the resilient layer 122 is formed with insertion holes 124, each of which axially extends from the side 123 of the resilient layer 122 to receive an associated iron core 141.

FIG. 6 shows another example of the reinforcing member 140 which comprises a cylindrical plate 142. As in FIG. 5, the cylindrical plate 142 is inserted into the resilient layer 122. For this purpose, the resilient layer 122 is formed with an insertion hole 125 which axially extends from the side 123 of the resilient layer 122 to receive the cylindrical plate 142. In comparison with the configuration shown in FIG. 5, when the cylindrical plate 142 is used as the reinforcing member, the end of the resilient layer 122 is effectively prevented from axially deforming, and productivity is improved due to the elimination of a complicated assembly operation.

Figure 7:
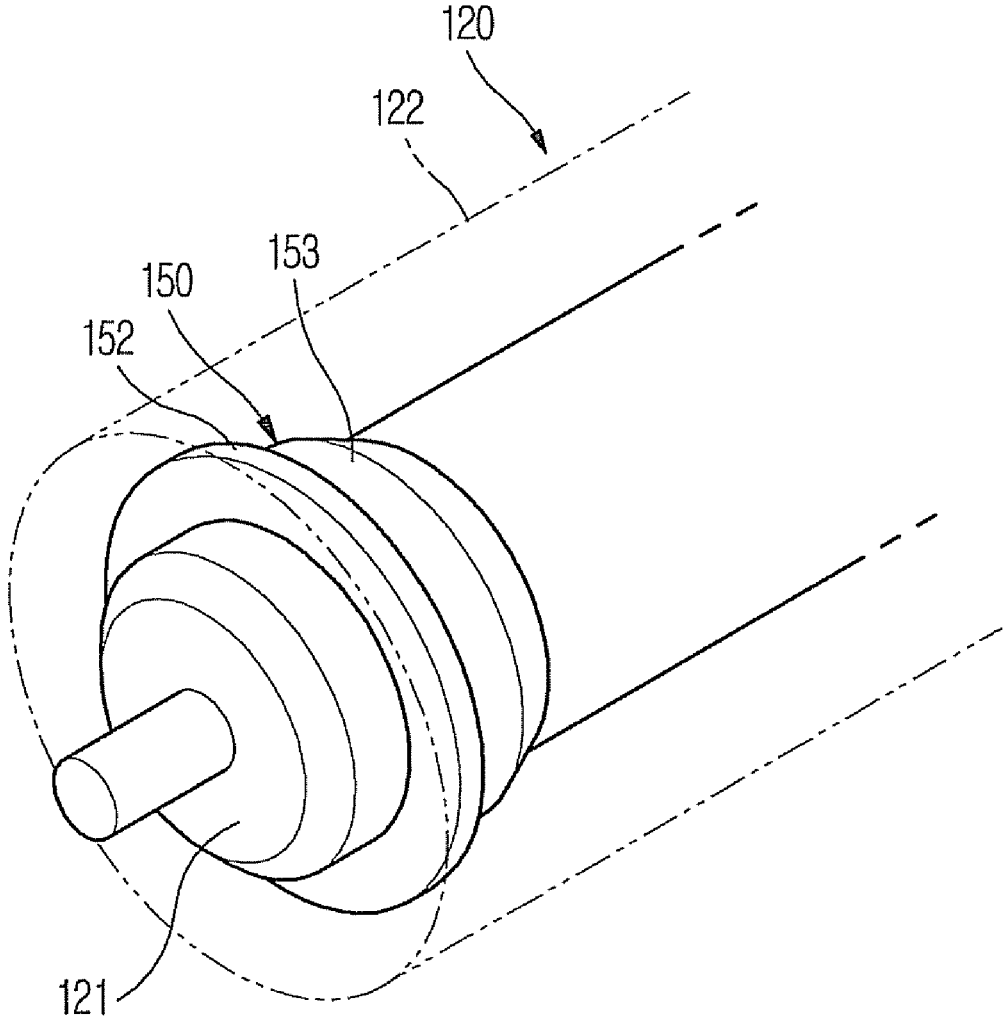
FIG. 7 is a perspective view schematically showing a pressure roller according to a fourth example embodiment of the present invention.
Figure 8:
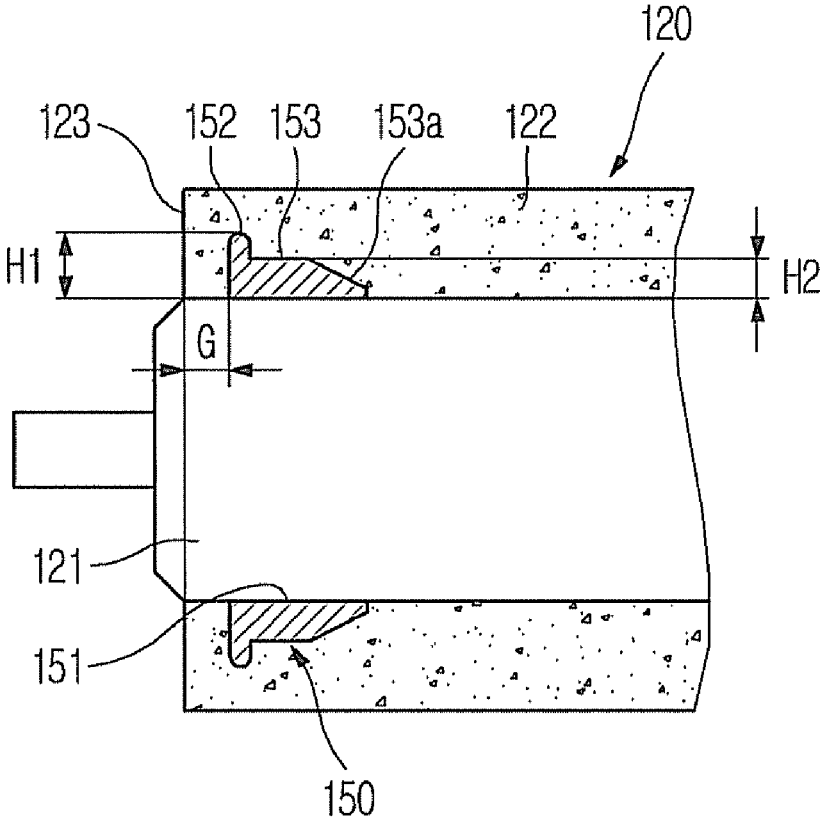
FIG. 8 is a cross-sectional view taken in an axial direction of the pressure roller of FIG. 7.

FIG. 7 is a perspective view schematically showing a pressure roller according to a fourth example embodiment of the present invention, FIG. 8 is a cross-sectional view taken in an axial direction of the pressure roller of FIG. 7, and FIGS. 9A to 9C are diagrams showing a method for manufacturing the pressure roller of FIG. 7. In the following description, the pressure roller of the fourth example embodiment will be described in view of different components, and the same components as those of the first example embodiment shown in FIG. 4 will be denoted by the same reference numerals as those of FIG. 4.

Referring to FIGS. 7 and 8, the pressure roller 120 of the fourth example embodiment comprises a reinforcing member 150 that is interposed between the shaft 121 and the resilient layer 122 at an end of the pressure roller 120 to reduce an amount of compressive deformation of the resilient layer 122. The reinforcing member 150 is formed of resin or metal that has a higher hardness than that of the resilient layer 122.

The reinforcing member 150 comprises a hollow section 151 through which the reinforcing member 150 is fitted into the shaft 121, a first reinforcing part 152 extending a first height H1 in a radial direction of the shaft 121, and a second reinforcing part 153 extending axially from the first reinforcing part 152 and having a second height H2, which is lower than the first height H1. The first reinforcing part 152 is positioned adjacent to the side 123 of the resilient layer 122, and the second reinforcing part 153 extends towards the center of the pressure roller 120 at an incline 153*a*. This configuration, in which the reinforcing member 150 is divided into two sections having different heights, is designed in consideration of the formability of the resilient layer 122. The design considerations of this configuration will be described below.

A method for manufacturing the pressure roller of FIG. 7 will hereinafter be described with reference to FIGS. 9A to 9C.

Figure 9A:
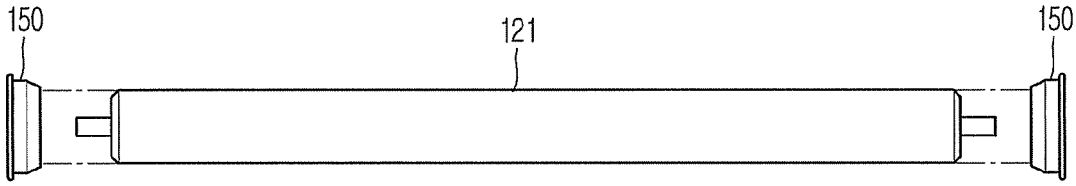
FIGS. 9A to 9C are diagrams showing a method for manufacturing the pressure roller of FIG. 7.

First, referring to FIG. 9A, a reinforcing member 150 is fitted into either end of a shaft 121. The reinforcing member 150 may be fitted into the shaft 121 by press-fitting or screw fastening methods. At this time, the reinforcing member 150 should be fitted such that a side 123 of a resilient layer 122 is separated a distance G of 2 mm from a first reinforcing part 152 (see FIG. 8). This allows the reinforcing member 150 to effectively prevent the axial deformation of the side 123 of the resilient layer 122 and to assure formation of the fixing nip at a region through which sheets pass.

Figure 9B:
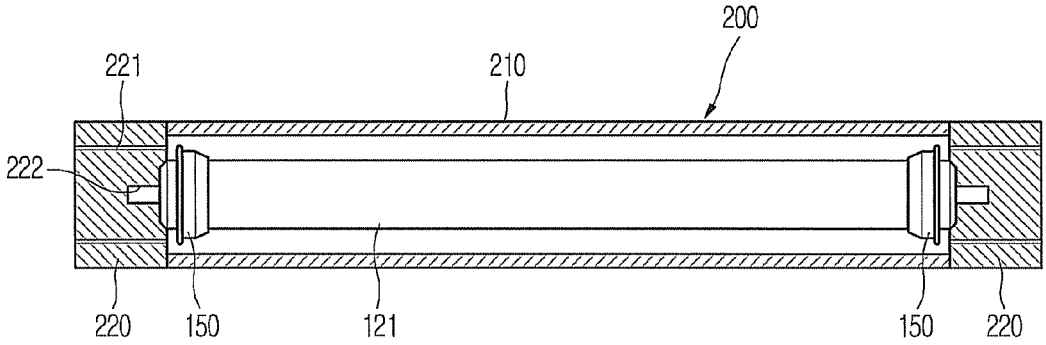
Figure 9C:
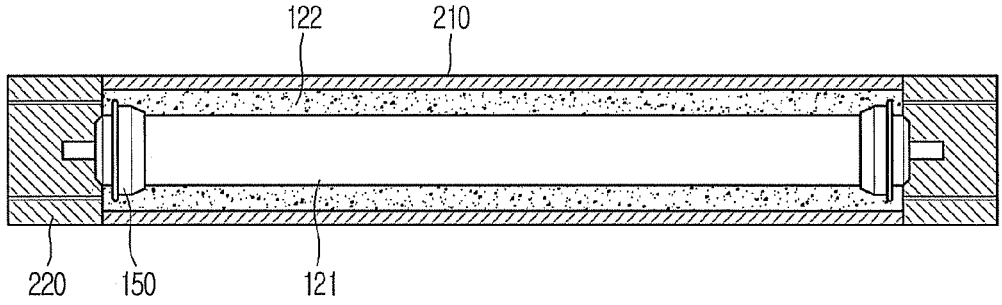

Next, referring to FIG. 9B, the shaft 121, which engages with the reinforcing members 150, is positioned within a mold unit 200 to allow for injection molding. The mold unit 200 comprises a cylindrical mold 210 where a resilient layer is molded, and a cover mold 220 to cover both open ends of the cylindrical mold 210. The cover mold 220 is formed to define an injection hole 221 through which material for the resilient layer is injected, and a bearing groove 222 which holds either end of the shaft positioned in the mold unit 200.

As shown in FIG. 9B, once the shaft 121, which engages with the reinforcing member 150, is positioned within the mold unit 200, the mold unit 200 is filled with the molding material as a result of an injection of the material through the injection hole 221 during the heating the mold unit 200. This way, a resilient layer 122 surrounding the shaft 121 and the reinforcing member 150 are formed as shown in FIG. 9C. In this state, the resilient layer 122 is solidified and shrunk by a cooling the resilient layer 122.

Figure 10:
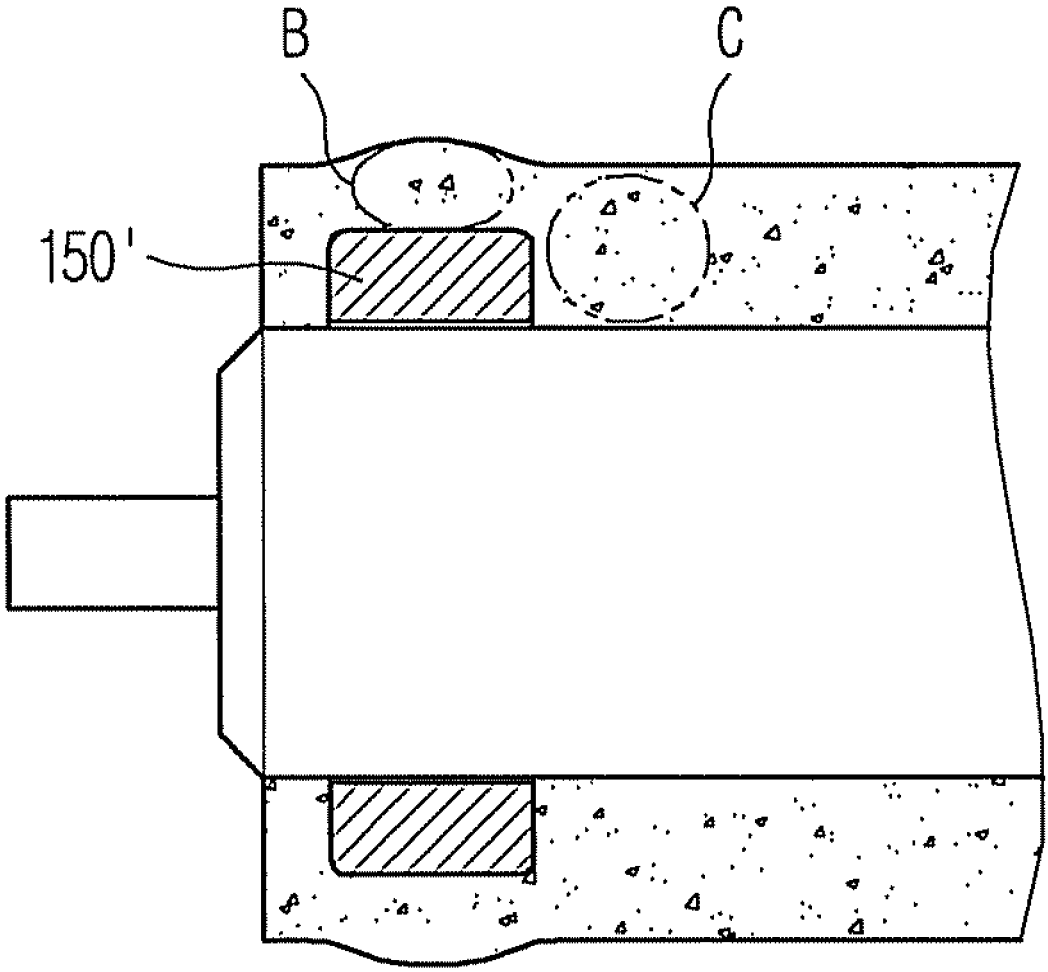
FIG. 10 is a view showing a comparative example in which a reinforcing member has a constant height.

For the reinforcing member of this example embodiment, a height H2 of a second reinforcing part 153 is lower than a height H1 of a first reinforcing part 152. This configuration is designed to account for shrinkage of the resilient layer 122 when producing the pressure roller 120. FIG. 10 shows a comparative example wherein the reinforcing member 150' has a constant height. In the event where the reinforcing member 150' has the constant height, a portion B of a resilient layer surrounding the reinforcing member 150' bulges due to a difference in thickness between the portion B of the resilient layer surrounding the reinforcing member 150' and a portion C of the resilient layer surrounding the shaft 121. In other words, since the portion B of the resilient layer is relatively thin, this portion is shrunk less upon the cooling the resilient layer. On the other hand, since the portion C of the resilient layer is relatively thick, this portion is likely to bulge. As a result, the surface of the resilient layer becomes non-uniform and mounting performance deteriorates.

Thus, according to the present invention, the axial deformation of the side 123 of the resilient layer 122 can be effectively prevented by forming the first reinforcing part 152 adjacent to the resilient layer 122 to have a relatively high height, and the outer peripheral surface of the resilient layer 122 can be prevented from bulging due to shrinkage of the resilient layer 122 by forming the second reinforcing part 153 extending towards the center of the resilient layer 122 to have a relatively low height, as shown in FIG. 8. In particular, when the second resilient part 153 is formed to have a tilt surface 153*a* gradually slanted downward towards the center of the resilient layer 122, it is possible to form a more uniform outer peripheral surface of the resilient layer 122.

As is apparent from the above description, compressive deformation in an undesired direction of a resilient layer of the pressure roller of the present invention is minimized, thereby preventing sheets from being crumpled when passing a fixing unit.

In addition, according to aspects of this invention, a fixing nip is prevented from being deformed into an unexpected shape due to the compressive deformation of the side of the resilient layer so that the fixing unit can maintain a stable fixing performance.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. Accordingly, it is intended, therefore, that the present invention not be limited to the various example embodiments disclosed, but that the present invention includes all embodiments falling within the scope of the appended claims.

What is claimed is:

1. An image forming apparatus, comprising:

a heating roller having a heat source installed therein;

a pressure roller, including a shaft and a resilient layer, to be brought into contact with the heating roller to form a fixing nip between the pressure roller and the heating roller, the shaft extending beyond the resilient layer in an axial direction; and a reinforcing member to reinforce a side of the resilient layer so as to prevent a compressive deformation of the resilient layer, the reinforcing member having a disc shape complementary to the shaft and the resilient layer to contact both.

2. The image forming apparatus according to claim 1, wherein a pass-hole through which the shaft extends is defined in the reinforcing member.

3. The image forming apparatus according to claim 2, wherein the complementary disc shape of the reinforcing member comprises a reinforcing surface closely attached to the side of the resilient layer to prevent the deformation of the resilient layer.

4. The image forming apparatus according to claim 1, wherein a radius of the reinforcing member is smaller than a distance between a center of the shaft and an outer peripheral surface of the resilient layer.

5. An image forming apparatus, comprising:

a heating roller having a heat source installed therein;

a pressure roller including a resilient layer to be compressed onto the heating roller to form a fixing nip between the pressure roller and the heating roller; and a reinforcing member received at an end of the resilient layer to increase a hardness of the resilient layer, wherein the reinforcing member comprises a hollow cylinder disposed about a central axis of the resilient layer and disposed the resilient layer to extend in an axial direction of the pressure roller.

6. An image forming apparatus, comprising:

a heating roller having a heat source installed therein;

a pressure roller, including a shaft and a resilient layer surrounding the shaft, the resilient layer being compressed onto the heating roller to form a fixing nip between the heating roller and the pressure roller; and a reinforcing member interposed between the shaft and the resilient layer at an end of the pressure roller to reduce an amount of compressive deformation of the resilient layer.

7. The image forming apparatus according to claim 6, wherein the reinforcing member comprises:

a hollow section by which the reinforcing member is fitted onto the shaft;

a first reinforcing part extending a first height in a radial direction of the shaft; and a second reinforcing part axially extending from the first reinforcing part and having a second height, which is lower than the first height.

8. The image forming apparatus according to claim 7, wherein a surface of the second reinforcing part is slanted downward and toward a middle of the pressure roller.

9. A method of manufacturing an image forming apparatus, the image forming apparatus comprising a pressure roller including a shaft and a resilient layer surrounding the shaft, the method comprising:

fitting a reinforcing member onto an end of the shaft to reduce an amount of compressive deformation of the resilient layer;

placing the shaft fitted with the reinforcing member within a mold; and injecting a material into the mold to form the resilient layer surrounding the shaft.

10. The method according to claim 9, wherein the reinforcing member comprises a disc shape.

11. The method of claim 9, wherein the reinforcing member is disposed at a distance from the end of the resilient layer toward the center of the pressure roller.

12. The method of claim 11, wherein the distance from the end of the resilient layer is about 2 mm.

13. The method according to claim 9, wherein the reinforcing member comprises:

a hollow section through which the reinforcing member is fitted onto the shaft;

a first reinforcing part extending a first height in a radial direction of the shaft; and a second reinforcing part extending axially from the first reinforcing part and having a second height lower than the first height.

14. A method of manufacturing an image forming apparatus, the image forming apparatus comprising a pressure roller including a shaft and a resilient layer surrounding the shaft, the method comprising:

installing a reinforcing member at an end of the shaft to reduce an amount of compressive deformation of the resilient layer;

placing the shaft, fitted with the reinforcing member, within a mold; and injecting a material into the mold to form the resilient layer surrounding the shaft, wherein the reinforcing member comprises a disc shape.

15. The method according to claim 14, wherein the disc shape comprises:

a hollow section to be coupled with the shaft;

a first reinforcing part extending a first height in a radial direction of the shaft; and a second reinforcing part extending axially from the first reinforcing part and having a second height lower than the first height.

* * * * *

UNITED STATES PATENT AND TRADEMARK OFFICE

CERTIFICATE OF CORRECTION

PATENT NO. : 7,650,106 B2
APPLICATION NO. : 11/762386
DATED : January 19, 2010
INVENTOR(S) : Jong Min Kim It is certified that error appears in the above-identified patent and that said Letters Patent is hereby corrected as shown below:

Column 1, Line 9, change "2006-105" to --2006-0105130--.

Signed and Sealed this

Twentieth Day of April, 2010

David J. Kappos

David J. Kappos
*Director of the United States Patent and Trademark Office*